US005605443A

United States Patent [19]

Schöning et al.

[11] Patent Number: 5,605,443

[45] Date of Patent: Feb. 25, 1997

[54] COMPRESSOR SET

[75] Inventors: Rudolf Schöning, Hohenroth; Manfred Balling, Bad Neustadt, both of Germany

[73] Assignee: Siemens Aktiengesellschaft, München, Germany

[21] Appl. No.: 428,099

[22] PCT Filed: Oct. 18, 1993

[86] PCT No.: PCT/DE93/00988

§ 371 Date: May 4, 1995

§ 102(e) Date: May 4, 1995

[87] PCT Pub. No.: WO94/11637

PCT Pub. Date: May 26, 1995

[30] Foreign Application Priority Data

Nov. 9, 1992 [DE] Germany ..... 9215231

[51] Int. Cl.[6] ..... F01D 25/24

[52] U.S. Cl. ..... 415/214.1; 415/182.1; 415/55.5

[58] Field of Search ..... 415/182.1, 214.1, 415/55.1, 55.5, 55.6

[56] References Cited

U.S. PATENT DOCUMENTS 4,204,802 5/1980 Schonwald et al. ..... 415/55.1
4,943,208 7/1990 Schoenwald ..... 415/55.1
4,992,022 2/1991 Aust et al. ..... 415/55.1
4,997,342 3/1991 Conger, IV ..... 415/214.1

FOREIGN PATENT DOCUMENTS 510672 8/1939 United Kingdom ..... 415/214.1

*Primary Examiner*—John T. Kwon
*Attorney, Agent, or Firm*—Kenyon & Kenyon

[57] ABSTRACT

A compressor set which comprises at least two side-channel compressors which are in an axially adjacent arrangement and have in each case a casing comprising at least two casing halves provided on their outer circumference with radially outwardly projecting connecting plates. The connecting plates are joined together by connecting elements which can be introduced into corresponding openings in the connecting plates. The production of such a compressor set and the distribution of the connecting forces are improved in that at least the two casing halves located in the middle of the compressor set are cast in the same manner. Also, the connecting plates provided on the casing halves are designed in such a manner that there is still space on both sides of a connecting element, which can be mounted in the middle of the circumference of the connecting plates, in each case for a further connecting element to be mounted.

12 Claims, 2 Drawing Sheets

COMPRESSOR SET

BACKGROUND OF THE INVENTION

The present invention relates to a compressor set having at least two side-channel compressors which are in an axially adjacent arrangement and have in each case a casing comprising at least two casing halves provided on their outer circumference with radially outwardly projecting connecting plates and which are joined together by connecting elements which can be introduced into corresponding openings in the connecting plates.

A compressor set of this type is shown in German Patent No. DE-U-7,715,000. In this compressor set, the four casing halves required for the two side-channel compressors are all of different designs. This leads to high production expenditure. The connection of the individual casing parts is effected by inserting the middle casing parts between the outer casing parts which are joined together by tie rods which engage on connecting plates provided on the outer casing parts. The total force must therefore be absorbed by the connecting plates of the outer casing parts.

It is an object of the present invention to provide a compressor set which is simpler to produce and in which the forces necessary for connecting the casing halves are distributed in an improved manner.

SUMMARY OF THE INVENTION

The object is achieved by the compressor set of the present invention which includes at least the two casing halves located in the middle of the compressor set which are cast in the same manner and the connecting plates provided on the casing halves are designed, at least on one end face of the casing halves, in such a way that there is still space on both sides of a connecting element (which can be mounted in the middle of the circumference of the connecting plates) in each case for a further connecting element to be mounted. Because of at least the inner casing halves being cast in the same manner, the expenditure for the diecasting tools necessary to produce the casing halves is reduced. In this case, a good transmission of the forces in the axial direction is achieved by the special design of the connecting plates without the need to include harmful bending moments in design tolerations. Additionally, the two inner casing halves can be joined together in advance to form a module.

A connection of the casing halves which is completely free from bending moments can be achieved in that in each case two connecting plates located on the one end face of the respective casing half are assigned one connecting plate which is located on the other end face of the casing half and is aligned symmetrically to the connecting plates.

The transmission of the forces over the full axial length of the compressor set without harmful bending moments is achieved according to a design of the invention in that connecting plates corresponding to the connecting plates of the casing halves located in the middle are also provided on the outer casing halves.

It is particularly expedient for the two connecting plates to be aligned with their mutually facing sides and approximately flush with the outer sides of the one connecting plate. In a compressor set of this type, a relief of the connecting forces on the actual casing can be achieved in that the connecting plates arranged on both end faces of the casing halves are joined together by axially extending webs. The webs engage on the two connecting plates in the region of their mutually facing sides and on the one connecting plate in the region of its outer sides.

DETAILED DESCRIPTION

Figure 1:
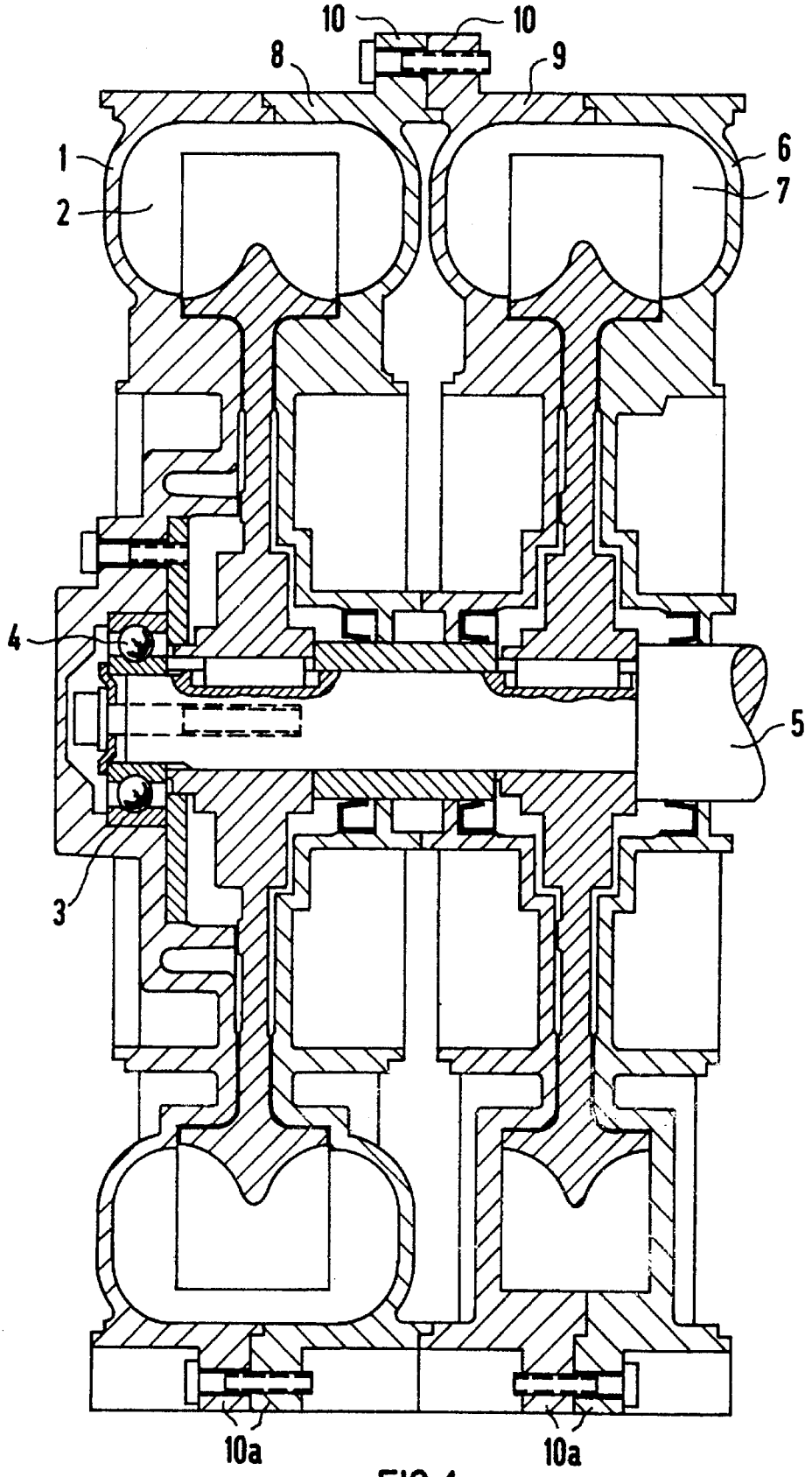
FIG. 1 is a cross-section through a compressor set of the present invention comprising two side-channel compressors.

In FIG. 1, the first outer casing half 1 of the one side-channel compressor 2 of the compressor set is located on the side facing away from the drive side of the compressor set and is provided with a bearing bore 3 for an end-side bearing 4 of the drive shaft 5 of the set. Arranged between the second outer casing half 6 of the other side-channel compressor 7 are the inner casing halves 8 and 9 of the two side-channel compressors 2 and 7.

The outer casing half 6 of the other side-channel compressor 7 and the two inner casing halves 8 and 9 are cast in the same manner. These casing halves 6, 8 and 9 must therefore only be processed correspondingly with respect to any necessary bores and centering edges. Connecting plates 10 and **10*a* are provided for joining together the individual casing halves 1, 6, 8 and 9 at their outer circumference. The connecting plates have corresponding passage bores 11 and threaded holes 12 into which screws 13 can be introduced as connecting elements (See FIGS. 2–4**).

The casting of the inner casing halves 8 and 9 and the outer casing half 6 of the other side-channel compressor 7 in the same manner requires a corresponding design of the connecting plates 10 so that these fit together even after the corresponding casing halves have been beaded.

Figure 2:
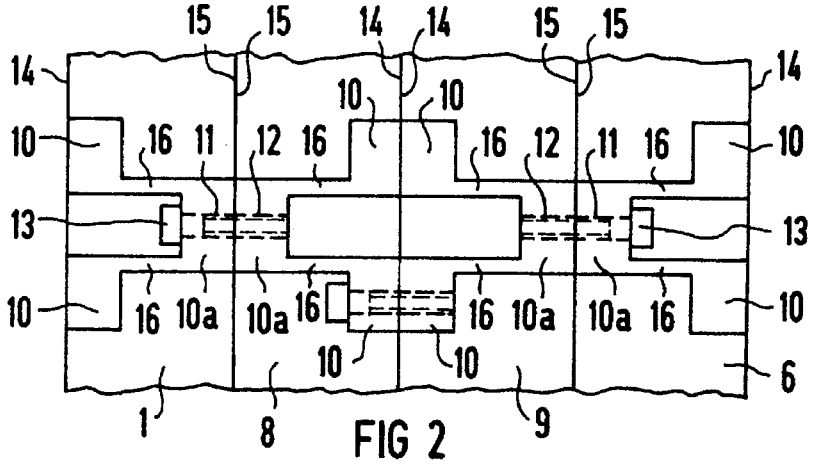
FIGS. 2–4 are plan views of various connections of the individual casing halves.
Figure 3:
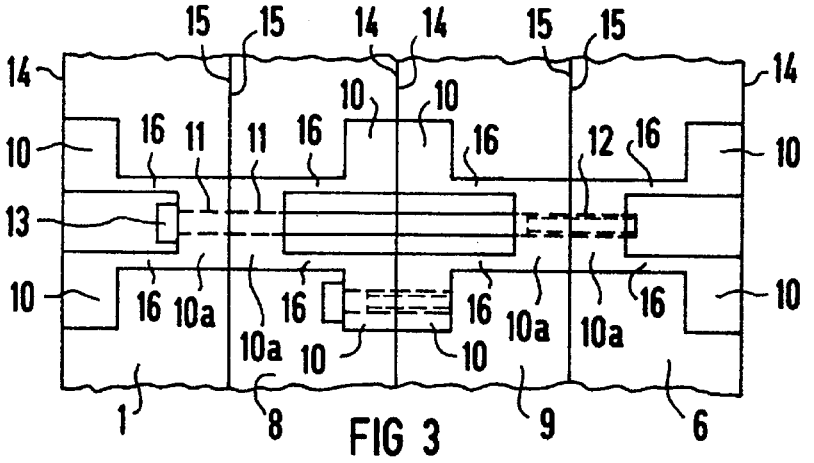

As can be seen in FIGS. 2 and 3, two connecting plates 10 are arranged with circumferential spacing from one another in each case at one end face 14 of each casing half 1, 6, 8 and 9. A connecting plate **10*a* is provided in each case on the other end face 15 of the casing halves 1, 6, 8 and 9 arranged centrally relative to the two connecting plates 10 of the one end face 14. Because of the turning of the corresponding casing halves, which is necessary in part because of the similar design of the casing halves 6, 8 and 9, either the two connecting plates 10 or the individual connecting plate 10*a* come to rest one in front of the other and can therefore be connected by corresponding screws 13. Because of the circumferential offset of the connecting plates 10 relative to the individual connecting plate 10*a*, it is possible to mount further connecting elements laterally relative to the individual connecting plate 10*a***.

In the design variation of FIG. 2, the individual connecting plates **10*a* located one in front of the other are joined together in each case by a single screw 13. In the case of the two spaced-apart connecting plates 10, a screw connection can be effected on one or both connecting plates 10. A screw connection on both connecting plates 10 leads to complete symmetry with respect to the connecting forces occurring in total. In the design variation of FIG. 3, the connection of the individual connecting plates 10*a* is effected by a screw 13 extending continuously over the inner casing halves 8 and 9**.

To increase strength, the two connecting plates 10 located on the one end face 14 are connected via axially extending webs 16 in each case to the individual connecting plate **10*a* located on the other end face 15. The webs 16 extend from the mutually facing sides of the two connecting plates 10 to the outer sides of the individual connecting plates 10***a*. A space thus remains on the circumference between the webs 16, through which the screws 13 can be passed.

Figure 4:
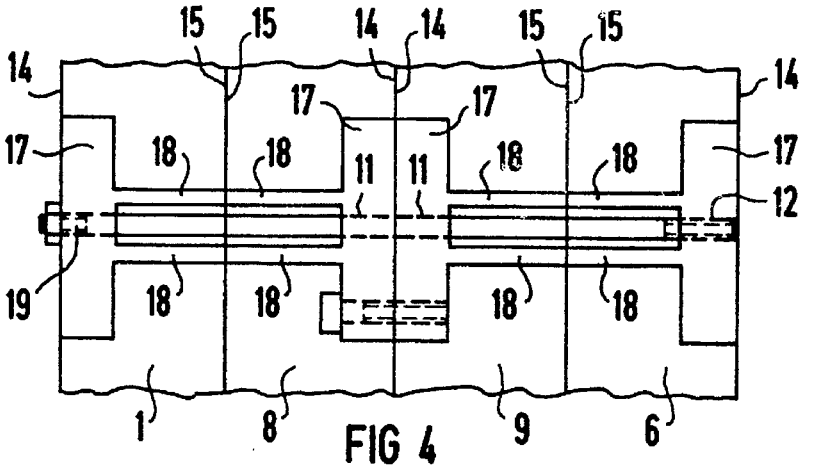

The illustration of FIG. 4 shows a further connection variation. Compared to the variations shown in FIGS. 2 and 3, the two connecting plates 10 spaced apart on the circumference are joined together to form a continuous, widened connecting plate 17 on the one end face 14. From these widened connecting plates 17, two supporting webs 18, spaced apart on the circumference, extend in each case in the axial direction to the other end face 15 of the casing halves 1, 6, 8 and 9. The inner casing halves 8 and 9 are joined together by screws introduced into the widened connecting plates 17. The joining of the outer casing halves 1 and 6 to one another and to the inner casing halves 8 and 9 is effected by continuous tie rods 19 which are arranged in the middle of the widened connecting plates 17 and engage on the widened connecting plates 17 of the outer casing halves 1 and 6.

We claim:

1. A compressor set comprising:

at least two side-channel compressors, said compressors being in an axially adjacent arrangement, wherein each of said compressors includes:

a casing comprising at least an inner casing half and an outer casing half, said inner and outer casing halves having an outer circumference, such that the inner casing halves of said compressor are located in a middle of said compressor set and are cast in a substantially similar manner;

radially, outwardly projecting connecting plates provided on said outer circumference of said inner and outer casing halves; and connecting elements joining together said inner casing halves and said inner and outer casing halves of each of said side-channel compressors, said connecting elements capable of being inserted into corresponding openings in said connecting plates, such that the connecting plates coupled to said inner casing halves of said compressors are designed at least on a first end face of said casing halves so that spaces exist on both sides of each of said connecting elements mounted in the middle of the circumference of said connecting plates, such that further connecting elements are mounted in said spaces.

2. The compressor set of claim 1 wherein two connecting plates located on each of said first end faces of said casing halves are assigned a connecting plate located on an opposite end face of said casing halves and are aligned symmetrically to said connecting plates.

3. The compressor set of claim 2 wherein said connecting plates coupled to said inner casing halves are also provided on the outer casing halves.

4. The compressor set of claim 3 wherein the connecting plates coupled to said inner casing halves are aligned with their mutually facing sides at least approximately flush with outer sides of at least one connecting plate coupled to said outer casing halves.

5. The compressor set of claim 4 wherein the connecting plates arranged on said first and opposite end faces of said inner and outer casing halves are joined together by axially extending webs, such that said webs engage on the two connecting plates coupled to said inner casing halves in a region of their mutually facing sides and such that said webs engage on at least one connecting plate coupled to said outer casing halves in a region of its outer sides.

6. The compressor set of claim 2 wherein the connecting plates coupled to said inner casing halves are aligned with their mutually facing sides at least approximately flush with outer sides of at least one connecting plate coupled to said outer casing halves.

7. The compressor set of claim 6 wherein the connecting plates arranged on said first and opposite end faces of said inner and outer casing halves are joined together by axially extending webs, such that said webs engage on the two connecting plates coupled to said inner casing halves in a region of their mutually facing sides and such that said webs engage on at least one connecting plate coupled to said outer casing halves in a region of its outer sides.

8. The compressor set of claim 1 wherein said connecting plates coupled to said inner casing halves are also provided on the outer casing halves.

9. The compressor set of claim 8 wherein the connecting plates coupled to said inner casing halves are aligned with their mutually facing sides at least approximately flush with outer sides of at least one connecting plate coupled to said outer casing halves.

10. The compressor set of claim 9 wherein the connecting plates arranged on said first and opposite end faces of said inner and outer casing halves are joined together by axially extending webs, such that said webs engage on the two connecting plates coupled to said inner casing halves in a region of their mutually facing sides and such that said webs engage on at least one connecting plate coupled to said outer casing halves in a region of its outer sides.

11. The compressor set of claim 1 wherein the connecting plates coupled to said inner casing halves are aligned with their mutually facing sides at least approximately flush with outer sides of at least one connecting plate coupled to said outer casing halves.

12. The compressor set of claim 11 wherein the connecting plates arranged on said first and opposite end faces of said inner and outer casing halves are joined together by axially extending webs, such that said webs engage on the two connecting plates coupled to said inner casing halves in a region of their mutually facing sides and such that said webs engage on at least one connecting plate coupled to said outer casing halves in a region of its outer sides.

* * * * *